United States Patent [19]

Francis et al.

[11] 4,346,386

[45] Aug. 24, 1982

[54] ROTATING AND TRANSLATING RADAR ANTENNA DRIVE SYSTEM

[75] Inventors: William H. Francis, Coconut Creek; Eckard F. Natter, Coral Springs, both of Fla.

[73] Assignee: The Bendix Corporation, Southfield, Mich.

[21] Appl. No.: 275,189

[22] Filed: Jun. 19, 1981

[51] Int. Cl.[3] ..... H01Q 13/10

[52] U.S. Cl. ..... 343/765; 343/705

[58] Field of Search ..... 343/765, 705–708, 343/763–766, 872

[56] References Cited

U.S. PATENT DOCUMENTS 2,258,186 10/1941 McNary et al. ..... 343/765

3,374,977 3/1968 Moy, Jr. ..... 343/765

*Primary Examiner*—David K. Moore

*Attorney, Agent, or Firm*—Bruce L. Lamb; W. G. Christoforo

[57] ABSTRACT

A mount and mechanism for imparting scan motion to a radar antenna useful in locations where obstructions forward of the antenna limit the field of view of the radar. The mount includes a carriage for translating the antenna transversely to the direction of beam propagation. Several mechanisms are disclosed for converting translatory motion to rotary motion and imparting the rotary motion as scanning motion to the antenna.

12 Claims, 8 Drawing Figures

ROTATING AND TRANSLATING RADAR ANTENNA DRIVE SYSTEM

The present invention relates to rotatable mountings for radar antennas. More particularly it relates to a mounting which translates the axes of rotation of an antenna while simultaneously rotating the antenna about the axis.

The present invention has particular utility in providing scanning motion for a radar antenna where nearby structure protruding forward of the antenna face may, in certain directions, interfere with the transmission of a radar beam.

Airborne weather radar antennas for multi-engine aircraft may be conveniently located in the nose of the fuselage where a clear field of view through a substantial volume of space is available. In single engine propeller driven aircraft the nose of the fuselage is usually occupied by the engine so that choice of a suitable location for the radar antenna becomes difficult.

Heretofore, in such single engine aircraft, the antenna mounting which has provided the best field of view has proven to be in a pod located near the wing tip. However, such an arrangement adversely affects the performance of the aircraft since it increases drag and generates asymmetrical loads on the aircraft.

It has been suggested that the aerodynamic penalties imposed by pod mounting the radar antenna might be avoided by mounting the antenna interiorly of the aircraft wing. In such case, the metal skin would be removed from a section of the wing leading edge and replaced by dielectric material thereby providing a radome-faced cavity within which the radar antenna might be mounted. However, the metal wing ribs which define the walls of such a cavity severely limit the field of view of an antenna mounted therein.

It is an object of the present invention to provide a radar antenna mount and scan mechanism which will increase the field of view of the radar which otherwise is limited by nearby structure.

It is another object of the invention to provide a radar antenna mount and scan mechanism of simple construction and reliable operation.

Briefly, the invention comprises a gimbal-like frame upon which the antenna is mounted through horizontal pivots, permitting tilting motion of the antenna about a horizontal axis. The frame is attached through vertical pivots to upper and lower carriages so that the antenna is free to scan about a vertical axis. The carriages travel on upper and lower horizontal tracks extending traversely to the antenna scan axis. A mechanism, several forms of which are disclosed, is coupled from the fixed base upon which the carriage tracks are mounted, either directly to the antenna or to the gimbal frame, to convert translatory motion of the antenna or frame to a rotary scan motion for the antenna.

Figure 1A:
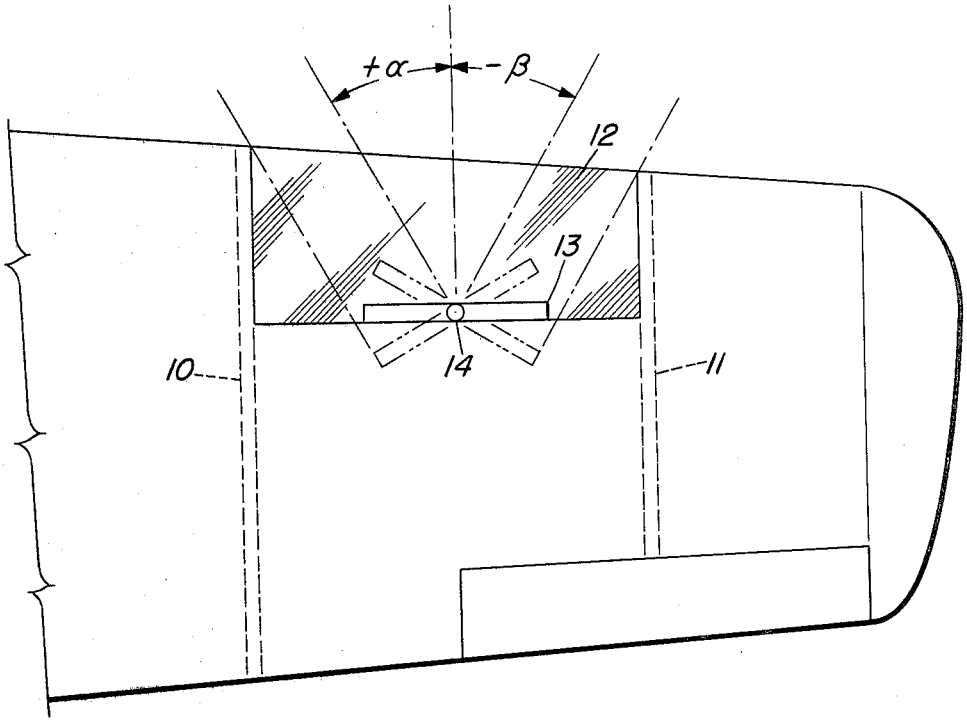
FIG. 1A is a diagram illustrating the limited field of view available to a radar antenna mounted within an aircraft wing.

FIG. 1A illustrates the limitation of the field of view of a radar antenna mounted interiorly of an aircraft wing and scanning about a fixed axis. A cavity for mounting the radar antenna is formed by removing a portion of the skin from the leading edge of the wing between ribs 10 and 11 and replacing it with dielectric material 12 which is transparent to microwaves. A radar antenna 13, shown as a flat plate but which could as well be a parabolic section, is mounted in the cavity for rotation about a fixed vertical axis passing through the point 14. The scan motion of the antenna 13 is limited in the positive direction to $+\alpha$ at which angle a ray from the left edge of the antenna encounters rib 10. The scan is limited in the negative direction to the angle $-\beta$ where a ray from the right edge of the antenna encounters rib 11.

Figure 1B:
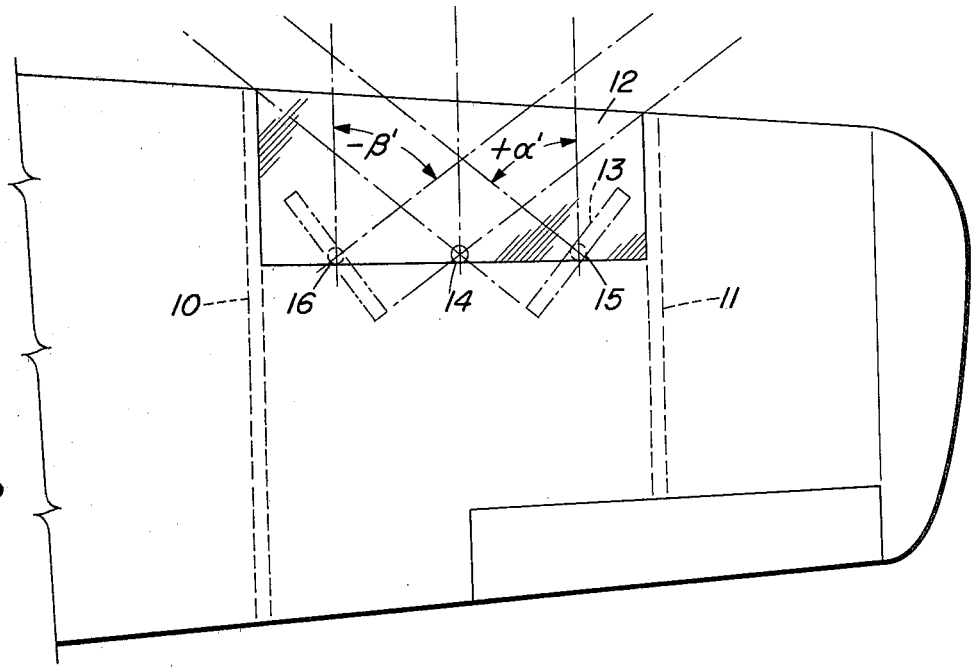
FIG. 1B is a diagram similar to FIG. 1A showing the increased field of view made available by the invention.

In FIG. 1B the antenna 13 is shown mounted in a cavity similar to that of FIG. 1A with provisions for translating the antenna scan axis to the left and right of the point 14 during rotation of the antenna. In this case, when the scan axis is translated to the right to the point 15 the positive limiting angle of scan is $+\alpha'$. When the scan axis is translated to the point 16 the negative limiting angle of scan is $-\beta'$. Clearly, the arrangement of FIG. 1B affords a substantial increase in the field of view, or total scan angle, over that available in FIG. 1A.

Figure 2:
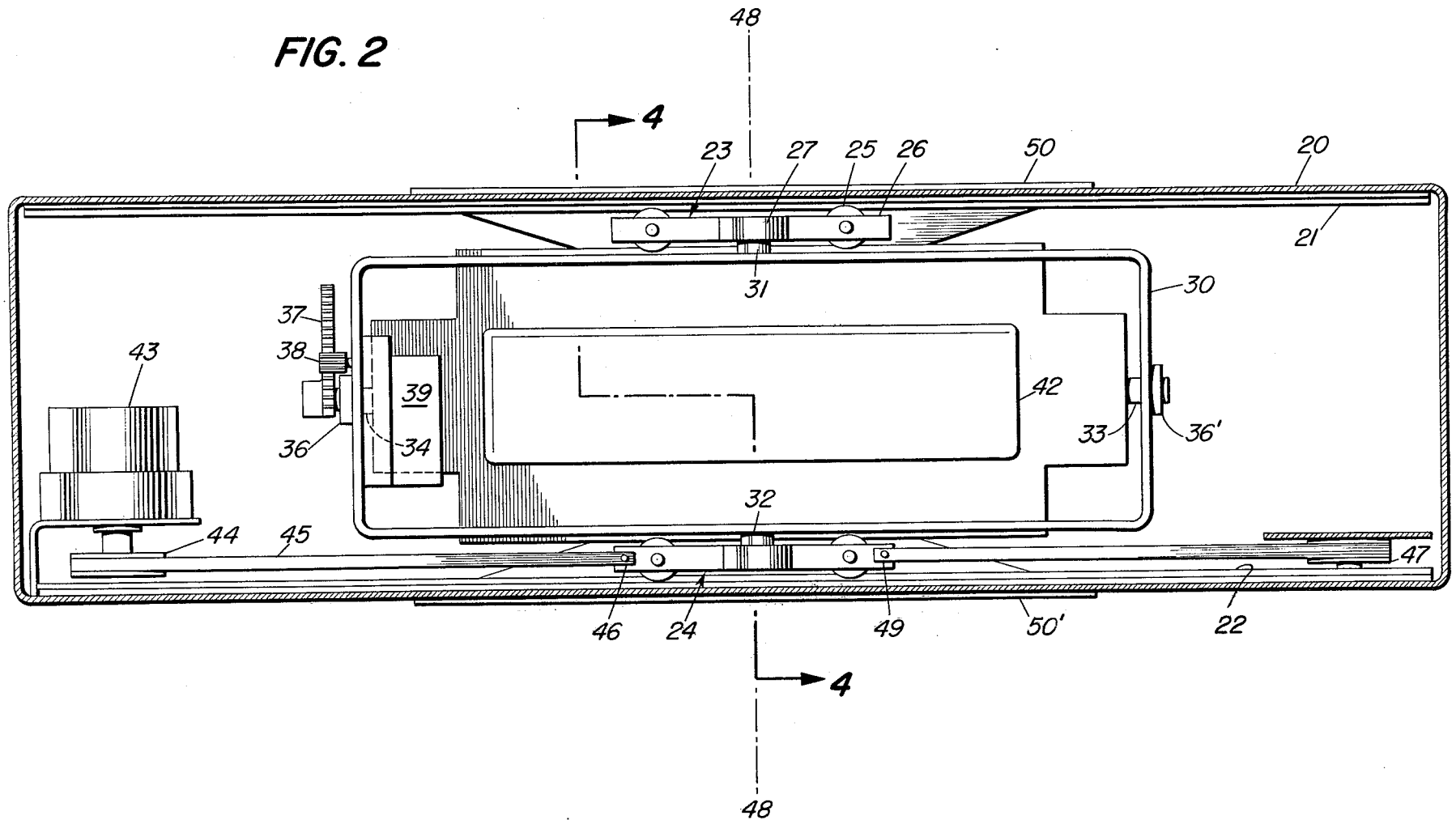
FIG. 2 is a rear elevation of the preferred embodiment of the invention.
Figure 3:
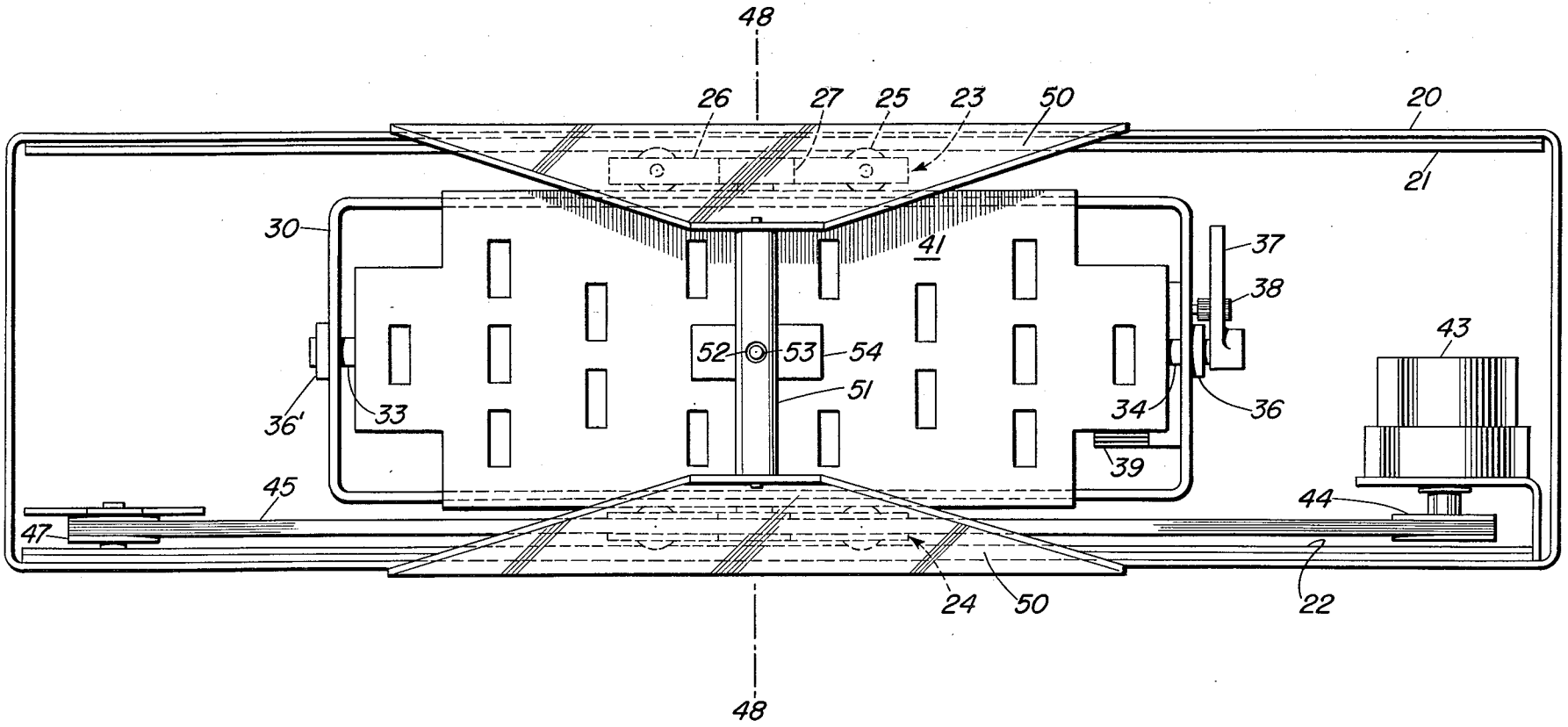
FIG. 3 is a front elevation of the embodiment of FIG. 2.
Figure 4:
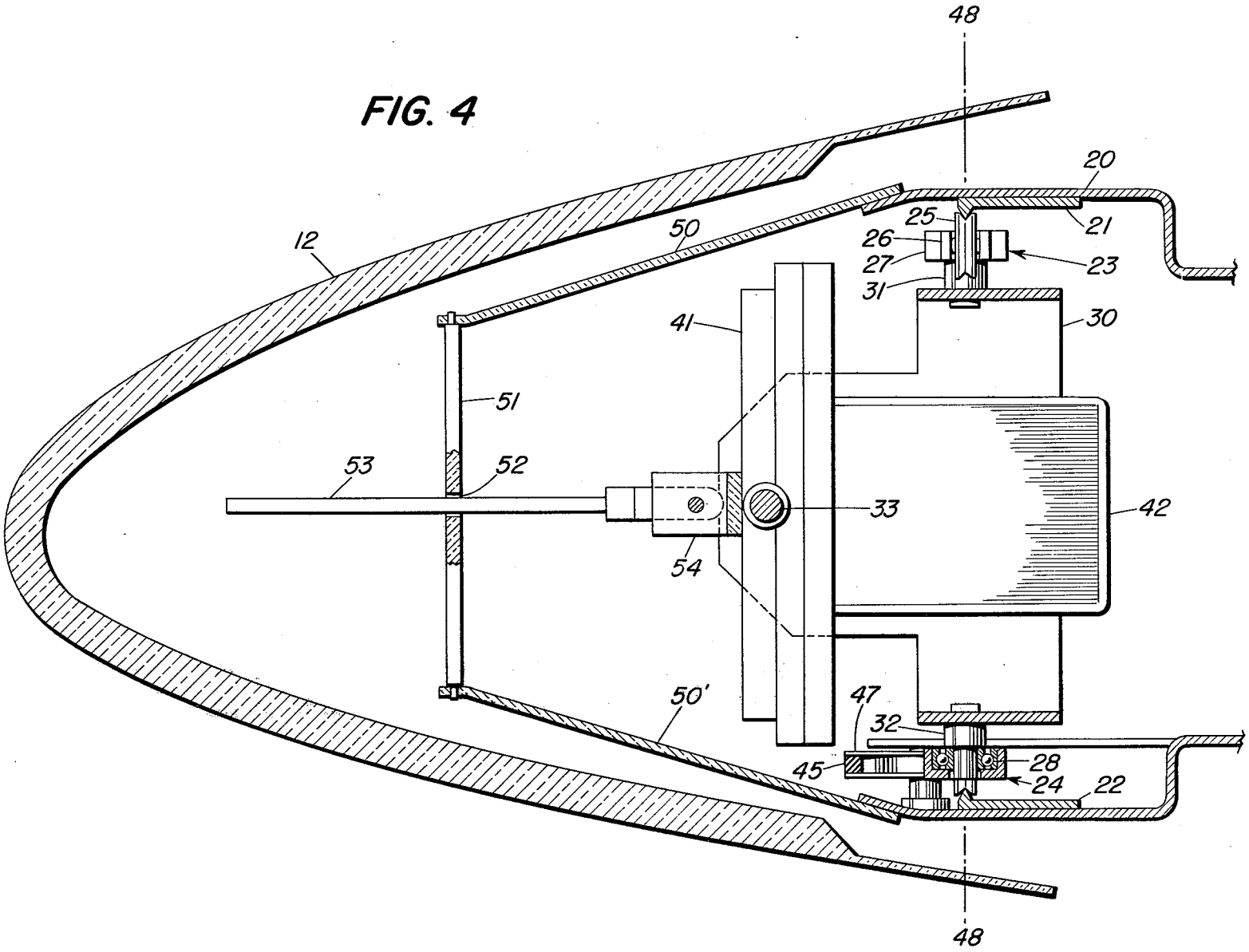
FIG. 4 is a sectional view taken along the line 4—4 of FIG. 2.

The present invention provides the scan motion of FIG. 1B. A preferred embodiment of the invention is shown in FIGS. 2–5. Referring particularly to FIGS. 2 and 3, an outer mounting frame 20 having a height and width substantially equal to those of a cavity formed in an aircraft wing, as shown in FIG. 1B, provides means for securing the antenna to an airframe. Within frame 20 are transversely extending top rail 21 and bottom rail 22. Upper and lower carriages 23, 24 travel on rails 21 and 22. As best seen in FIGS. 2 and 4, each of the carriages 23, 24 include a pair of flanged wheels 25 mounted at the outer ends of an elongate truck frame 26, the center of which is broadened to provide a bolster 27 supporting a thrust bearing 28. A gimbal frame 30 is supported for motion about a vertical axis by trunions 31 and 32 fitted to the upper and lower thrust bearings 28. A pair of pivot shafts 33 and 34 extend horizontally from an antenna mounting frame 35 into journals 36, 36' carried by gimbal frame 30. Shaft 34 extends through journal 36' for coupling to a sector gear 37. Gear 37 meshes with a pinion 38 driven by a stepping motor 39 for tilting the antenna frame 35 so that the antenna can be scanned in planes above and below the horizontal.

As best seen in FIG. 3, frame 35 mounts the radar antenna 41, shown in the drawings a flat plate constructed of a stacked array of slotted waveguides. Other forms of antenna such as a parabolic section or a horn may be used. A housing 42, best seen in FIG. 4, fixed to the rear of antenna 41 provides a containment for certain components of the radar transmitter and receiver.

Again referring to FIG. 2, carriages 23 and 24 are driven reciprocally along tracks 21 and 22 by a reversible motor 43. Motor 43 drives a sprocket wheel 44 around which is passed a serrated belt 45. Belt 45 is fastened at one end 46 to carriage 24, looped around sprocket 44 to pass free forward of carriage 24 and looped back through a pulley 47 to be fastened at the opposite end 49 to the opposite end of carriage 24. Reciprocation of carriages 23 and 24 along tracks 21 and 22 translates the antenna scan axis 48—48 between positions 15 and 16 shown in FIG. 1B. The mechanism next to be described converts the translatory motion of the scan axis to rotary motion of the antenna about the scan axis.

Figure 5:
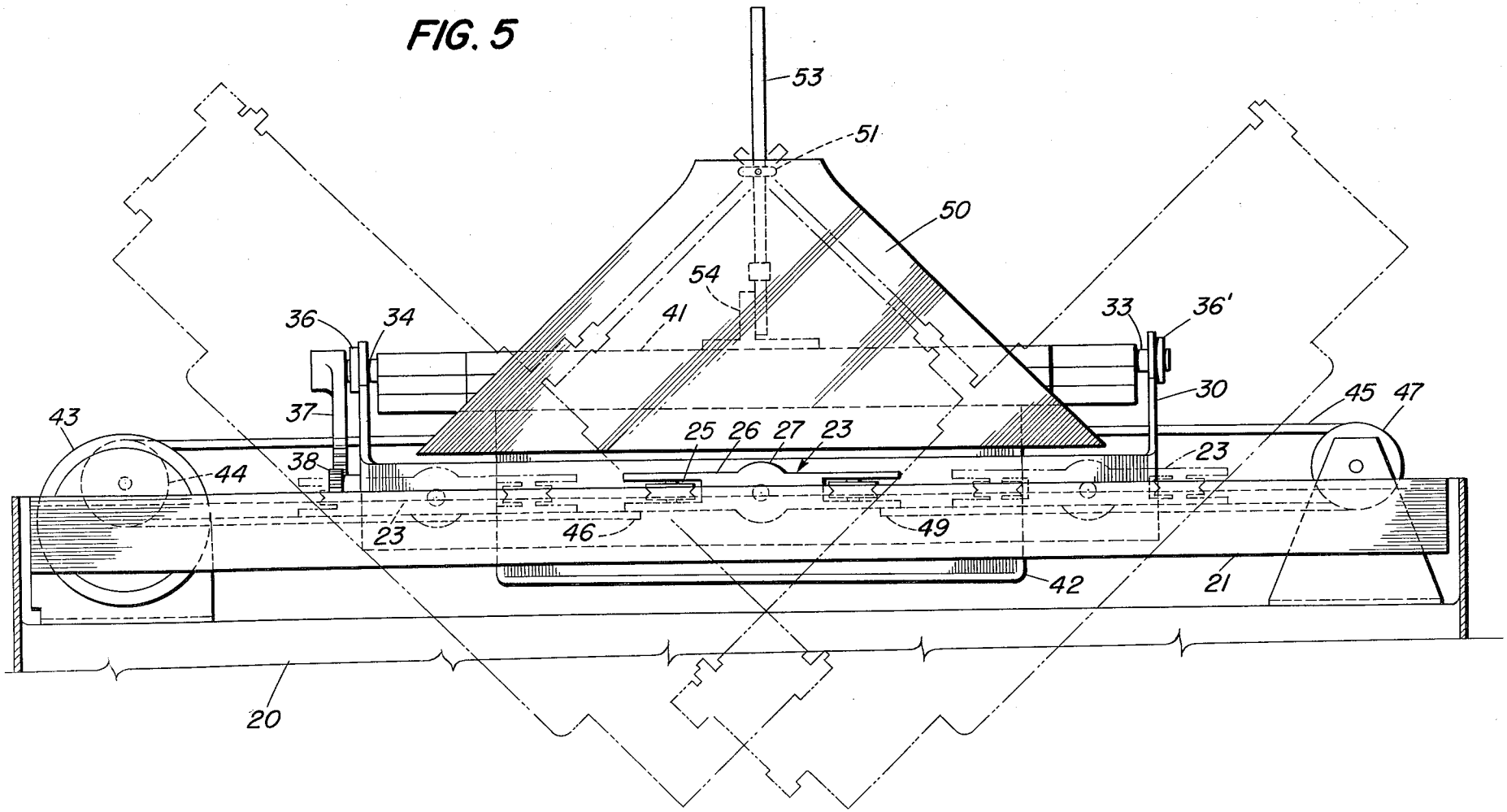
FIG. 5 is a plan view of the embodiment of FIG. 2.

Referring particularly to FIGS. 3, 4 and 5, a pair of triangular plates 50 and 50' of dielectric material are fixed to frame 20 to extend forward of the face of antenna 41. A vertical dielectric rod 51 is pivotally supported at the forward ends of plates 50, 50'. A hole 52 is centrally located in rod 51 in the plane of pivot shafts 33 and 34. A guide rod 53 of dielectric material passes through hole 52 and is free to slide therein. The end of rod 53 adjacent the face of antenna 41 is secured to a pivot block 54 of dielectric material so as to be free to pivot relative to the antenna in a vertical plane but constrained against movement relative to the antenna in a horizontal plane.

Elements 50–54 together with carriages 23 and 24 and their associated components form a kinematic chain known in the art as a double slider mechanism. As seen in the phantom views of FIG. 5, as carriages 23 and 24 are translated to the right, rod 53 retracts through hole 52 while rod 51 pivots toward the left. Rod 53, being constrained against horizontal rotation relative to the antenna 41, forces the antenna to rotate towards the left about its scan axis 48—48. Upon translation of the carriages 23 and 24 to the left, rod 53 also retracts in hole 52 as rod 51 pivots to the right, while antenna 41 is forced to rotate toward the right.

Figure 6:
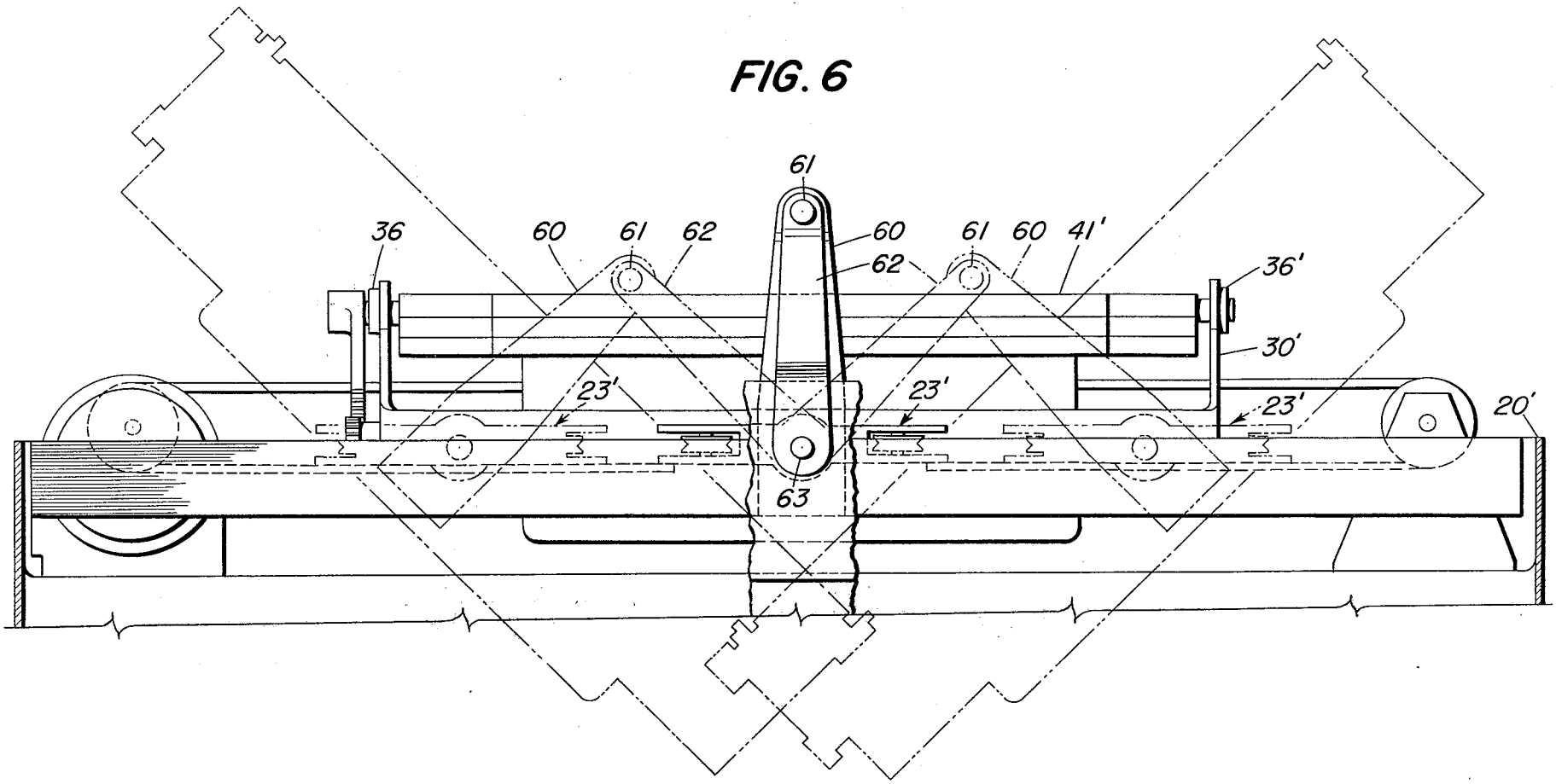
FIG. 6 is a plan view of an alternative embodiment of the invention.
Figure 7:
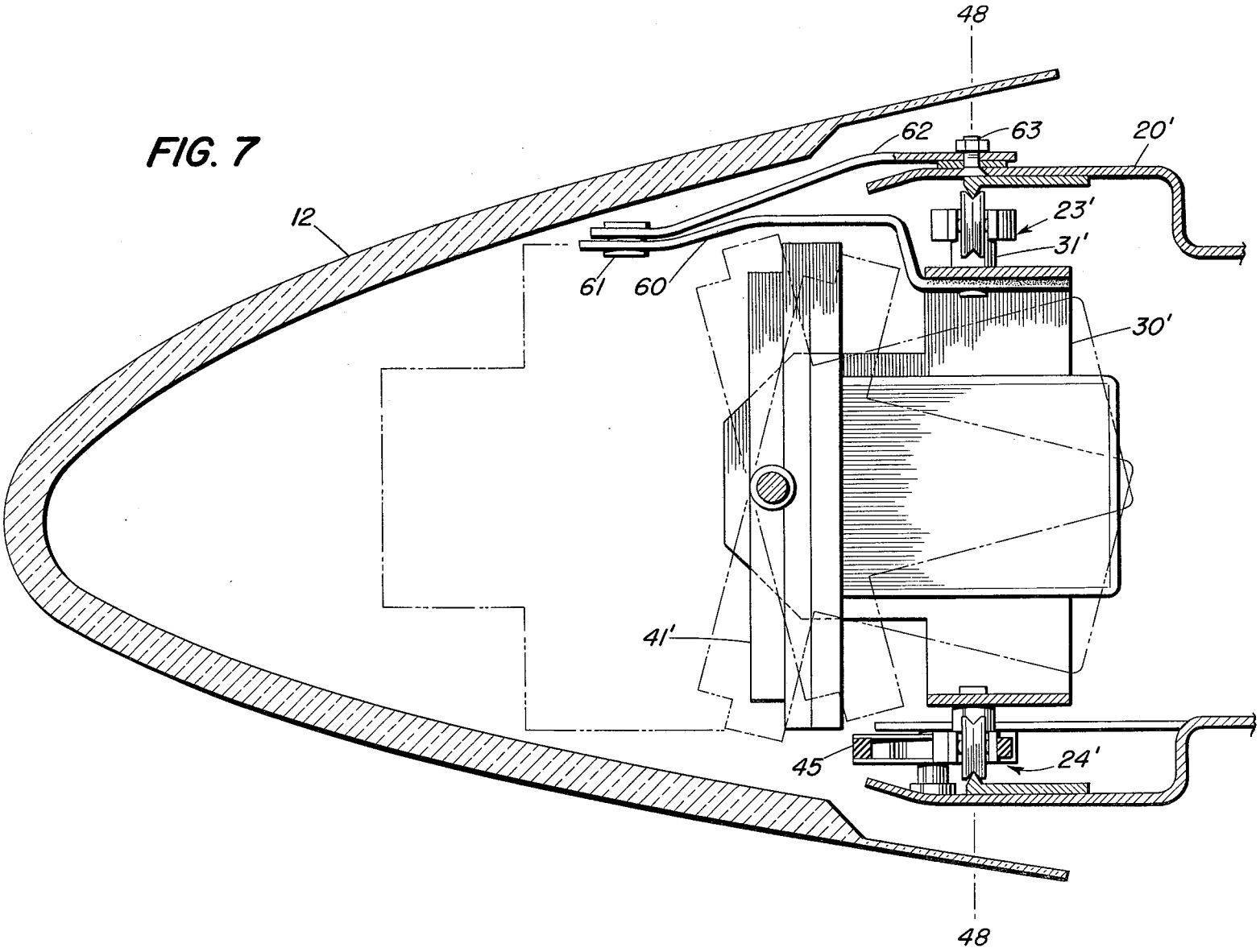
FIG. 7 is an end view of the embodiment shown in FIG. 6.

A second embodiment of the invention is shown in FIGS. 6 and 7. In this embodiment the double slider mechanism of FIGS. 2–5 is replaced by a crank and swinging link mechanism which converts translatory motion of the carriages 23' and 24' to rotary scan motion of the antenna 41'. A generally L-shaped crank 60 is rigidly attached to the upper trunion 31' of gimbal frame 30' along a line extending perpendicular to and forward of the gimbal frame. The forward end of crank 60 is attached through a pivot joint 61 to the forward end of a swinging link 62. The rear end of link 62 is attached through a pivot joint 63 to the upper member of outer frame 20'. Carriages 23', 24' and gimbal frame 30' are otherwise identical to corresponding elements of FIGS. 2–5.

As best seen in the phantom views of FIG. 6, as carriages 23' and 24' translate the antenna scan axis 48—48 to the right, travel of crank 60 urges pivot joint 61 toward the right. However, pivot 61 is constrained by link 62 to travel along a circular arc, the center of which is pivot joint 63. Crank 60 is therefore forced to rotate toward the left, thereby rotating antenna 41' about its scan axis toward the left. When carriages 23' and 24' translate the antenna scan axis 48—48 to the left of center, crank 60 urges pivot 61 to the left which is again forced by link 62 to travel along an arc, the center of which is pivot 63. Crank 60 is therefore forced to rotate to the right, thereby causing the antenna 41' to rotate about its scan axis to the right.

Although the first described embodiment of the invention has the disadvantage of introducing a certain amount of attenuation in the radar transmitter signal because of the presence of the dielectric materials in the radar beam that embodiment of the invention is preferred over the second described embodiment because it permits relaxation of manufacturing tolerances. In the latter, very little play is permissible in the mechanism, else it is subject to jamming as it moves through the center position where crank 60 and link 62 are in alignment.

The invention claimed is:

1. A rotating and translating mount for a radar antenna comprising, a base;

a carriage adapted to move translationally along said base;

a radar atenna;

means for securing said antenna to said carriage for rotary motion of said antenna about an axis orthogonal to the direction of translational motion of said carriage; and a double slider mechanism for converting translational motion of said carriage to rotary motion of said antenna, said mechanism including a rod rigidly attached to said antenna and extending in the direction of the beam produced by said antenna; and means attached to said base and slidingly engaging said rod to constrain said rod to pass through a point fixed relative to said base during motion of said carriage.

2. A rotating and translating mount for a radar antenna comprising, a base;

a straight rail fixed to said base;

a carriage including a pair of flanged wheels traveling on said rail;

a frame pivotally mounted on said carriage to permit rotary motion of said frame about an axis perpendicular to the line of motion of said carriage;

a radar antenna;

means securing said antenna in said frame so that the energy beam propagated by said antenna is in a direction transverse to the direction of said rail;

means for translating said carriage along said rail; and means coupled to said base and to said antenna to convert linear translatory motion of said carriage to rotary motion of said antenna whereby any linear translatory motion applied to said carriage imparts rotary motion to said antenna.

3. An antenna mount as claimed in claim 2 wherein said means for converting translatory motion of said carriage to rotary motion of said antenna comprises, a rod attached to the face of said antenna centrally thereof, said rod being constrained against motion in a horizontal plane relative to said antenna; and means slidingly engaging said rod at a point forward of the face of said antenna to constrain said rod to pass through said point during translatory motion of said antenna.

4. An antenna mount as claimed in claim 3 wherein said means securing said antenna in said frame include horizontal pivots to permit tilting motion of said antenna relative to said frame while constraining said antenna against horizontal motion relative to said frame.

5. An antenna mount as claimed in claim 4 wherein said rod is attached to said antenna with freedom to pivot relative thereto in a vertical plane.

6. An antenna mount as claimed in claim 2 wherein said means for converting translatory motion of said carriage to rotary motion of said frame comprises, a crank having one end rigidly attached to said antenna and having an arm projecting forwardly of said antenna; and a link having one end pivotally attached to said base and the other end thereof pivotally attached to the end of said crank arm forward of said antenna.

7. A rotating and translating mount for a radar antenna comprising, an open rectangular base formed of top and bottom horizontal walls and vertical side walls;

top and bottom rails secured to said top and bottom base walls along straight lines and in facing relationship;

top and bottom carriages adopted to travel on said top and bottom rails;

a frame;

trunion means attaching said frame to said top and bottom carriages to permit rotary motion of said frame relative to said carriages, said rotary motion being about a vertical axis;

means causing said carriages to travel reciprocally along said rails;

a radar antenna secured to said frame; and means coupled to said base and to said frame for converting linear reciprocating motion of said carriages to rotary motion of said frame whereby any linear reciprocating motion applied to said carriages imparts rotary motion to said frame.

8. An antenna mount as claimed in claim 7 wherein said antenna is secured to said frame by pivotal means permitting pivotal motion of said antenna relative to said frame, said pivotal motion being about a horizontal axis.

9. An antenna mount as claimed in claim 7 wherein said means for converting reciprocating motion to rotary motion comprises, a rod;

means attaching said rod to said antenna so as to project forward of the face of said antenna, said attaching means constraining said rod against movement relative to said antenna in a horizontal plane; and means secured to said base and slidingly engaging said rod at a point forward of the face of said antenna to constrain said rod to pass through said point during motion of said rod in a horizontal plane.

10. An antenna mount as claimed in claim 9 wherein said attaching means attach said rod to said antenna centrally of the face of said antenna.

11. An antenna mount as claimed in claim 10 wherein said rod and said means engaging said rod are constructed, at least in part, from dielectric material.

12. An antenna mount as claimed in claim 10 wherein said antenna is secured to said frame by pivotal means permitting pivotal motion of said antenna relative to said frame and wherein said means attaching said rod permit pivotal motion of said rod relative to said antenna, said pivotal motion of said antenna and said pivotal motion of said rod each being about a horizontal axis.

* * * * *